United States Patent [19]

Pugh

[11] Patent Number: 4,629,068

[45] Date of Patent: Dec. 16, 1986

[54] MODULAR DISPLAY PACKAGE

[75] Inventor: Richard E. Pugh, Lancaster, Ohio

[73] Assignee: Anchor Hocking Corporation, Lancaster, Ohio

[21] Appl. No.: 779,930

[22] Filed: Sep. 25, 1985

Related U.S. Application Data

[62] Division of Ser. No. 639,902, Aug. 13, 1984, abandoned.

[51] Int. Cl.[4] ..... B65D 85/44

[52] U.S. Cl. ..... 206/426; 206/45.14; 206/434; 206/446; 229/16 D; 229/40

[58] Field of Search ..... 206/45.14, 45.15, 45.19, 206/426, 434, 446, 419, 420, 421, 526, 491, 422, 427, 429; 229/16 D, 40, 41 B

[56] References Cited

U.S. PATENT DOCUMENTS

| | | | |
|---|---|---|---|
| 1,888,855 | 11/1932 | Fuller | 206/419 |
| 2,571,833 | 10/1951 | Chidsey, Jr. | 206/434 |
| 2,690,839 | 10/1954 | Robinson | 206/434 |
| 2,881,914 | 4/1959 | Woeber et al. | 206/434 |
| 2,888,135 | 5/1959 | Guyer | 206/434 |
| 3,083,825 | 4/1963 | Larsen | 206/434 |
| 3,358,828 | 12/1967 | Tolaas | 206/434 |
| 3,411,696 | 11/1968 | Ayer et al. | 206/491 |
| 3,463,306 | 8/1969 | Taylor | 206/434 |
| 3,604,614 | 9/1971 | Sternfeld | 206/434 |
| 3,627,117 | 12/1971 | Glesler | 206/491 |
| 3,758,020 | 9/1973 | Childs et al. | 206/422 |
| 4,164,286 | 8/1979 | Sutherland | 206/434 |

FOREIGN PATENT DOCUMENTS

| | | | |
|---|---|---|---|
| 2451871 | 11/1980 | France | 206/426 |
| 7513041 | 5/1977 | Netherlands | 206/426 |

*Primary Examiner*—Joseph Man-Fu Moy
*Assistant Examiner*—David T. Fidei

[57] ABSTRACT

A package is described which includes individual paperboard packages folded from blanks and which contain and display articles such as glass tumblers or goblets. The individual packages are assembled in sleeves also folded from paperboard blanks which accommodate two, three or four of the individual packages while exposing them for display.

4 Claims, 32 Drawing Figures

MODULAR DISPLAY PACKAGE

This patent application is a division of patent application Ser. No. 639,902 filed Aug. 13, 1984 now abandoned.

BACKGROUND OF THE INVENTION

The present invention is directed to a modular package and more particularly to an improved modular display package for glass articles, such as tumblers.

Existing display packages for glass articles are not easily erected and packed in shipping cartons by automatic machinery so that manual handling is necessary. Such existing packages do not give the glassware maximum visibility, insure the glassware against damage, and do not permit inspection by the consumer without destroying the display package. Furthermore, existing display packages do not easily accommodate stemware as well as tumblers and are not well adapted to accommodate a multiplicity of sizes as is the package of the present invention. In addition, the new display packages are amenable to palletization and at the same time, permit opening of the outer cartons for pricing and label application. Many existing display packages, which use partitions for separating the articles, require a large amount of shelf space and are not easily amenable to varying uses for appearances and for marketing requirements.

BRIEF DESCRIPTION OF THE INVENTION

The present invention overcomes the above noted drawbacks and has as one of its objects the provision of an improved display package which can be easily erected and packed in shipping cartons by automatic machinery.

Another object of the present invention is the provision of an improved display package which has maximum visibility, which insures protection from damage and which permits inspection by the consumer without destroying the display package.

Another object of the present invention is the provision of an improved display package which is able to accommodate stemware as well as tumblers and which is capable of accommodating a multiplicity of sizes.

Another object of the present invention is the provision of an improved display package which eliminates the use of partitions for separating the articles.

Another object of the present invention is the provision of an improved display package which increases the protection of the glassware packaged therein.

Another object of the present invention is the provision of an improved display package which requires less shelf space and which permits diverse utilizations for different appearances and marketing requirements.

Other and further objects of the invention will be obvious upon an understanding of the illustrative embodiment about to be described, or will be indicated in the appended claims, and various advantages not referred to herein will occur to one skilled in the art upon employment of the invention in practice.

BRIEF DESCRIPTION OF THE DRAWING

A preferred embodiment of the invention has been chosen for purposes of illustration and description and is shown in the accompanying drawings forming a part of the specification, wherein.

DESCRIPTION OF THE INVENTION

Figure 1:
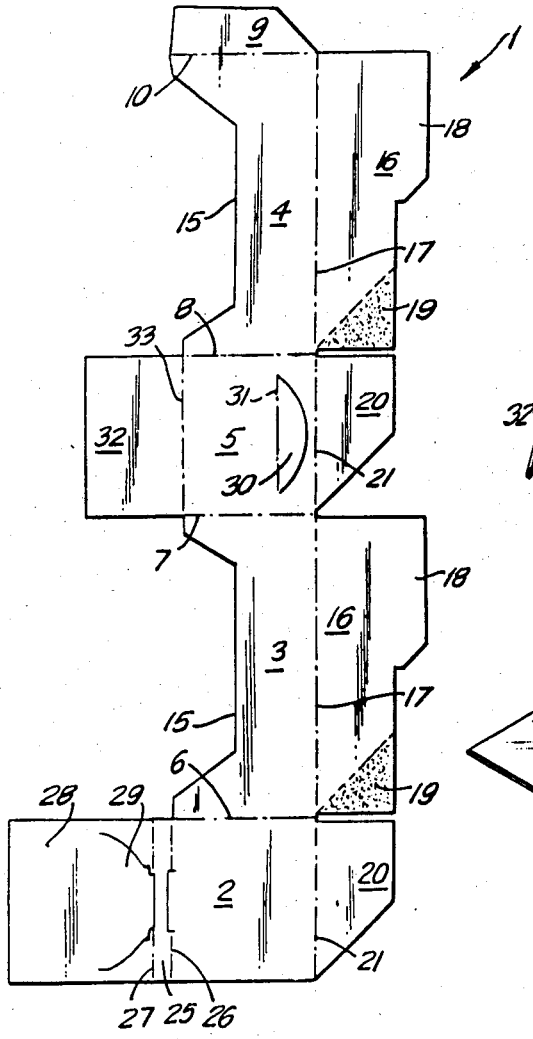
FIG. 1 is a plan view of a blank used to form a modular package in accordance with the present invention.

Referring more particularly to the drawings and to the embodiment shown in FIGS. 1 to 6, the blank 1 of the present invention comprises a bottom wall panel 2, a pair of side wall panels 3 and 4 and a top wall panel 5 hingedly connected to each other along fold lines 6, 7 and 8. The side wall panel 4 has a glue flap 9 extending therefrom and foldable along fold line 10. The side wall panels 3 and 4 are substantially similarly shaped and each has a cutout portion 15 therein. Each side wall panel has a rear wall panel 16 extending therefrom and foldable relative thereto along a fold line 17. Each rear wall panel 16 has an interlocking tab 18 extending therefrom and a glue area 19. The bottom and top wall panels 2 and 5 have a rear flap panel 20 extending therefrom and foldable relative thereto along fold line 21.

The bottom wall panel 2 has a narrow front step panel 25 extending therefrom and foldable along fold line 26 and attached thereto and foldable along fold line 27 is a lower retaining wall panel 28. The lower retaining wall panel 28 has an arcuate tongue 29 therein to form an article holding slot. The top wall panel 5 has an article retaining tongue 30 cut therein and foldable relative thereto along a fold line 31 and an upper pressure-applying panel 32 foldable relative thereto along a fold line 33.

Figure 2:
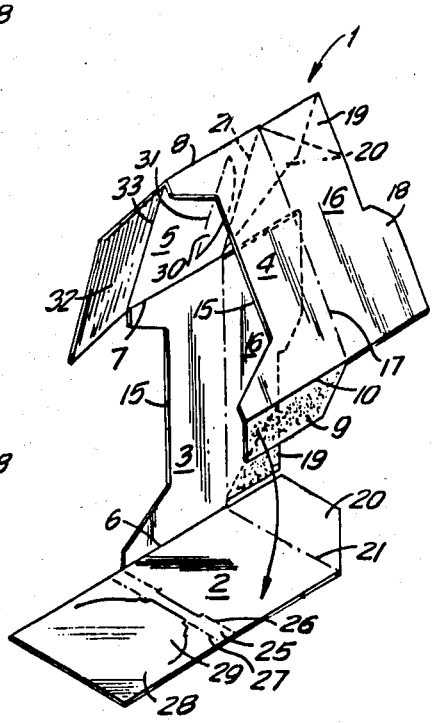
FIG. 2 is a perspective view showing an initial step in folding the blank into a package.
Figure 3:
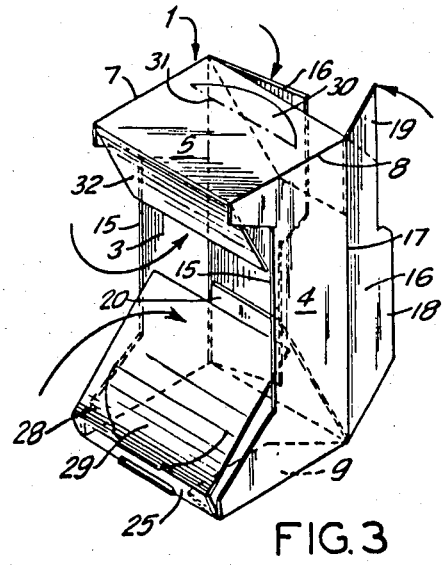
FIG. 3 is a perspective view showing the final step in folding the blank into a package.
Figure 4:
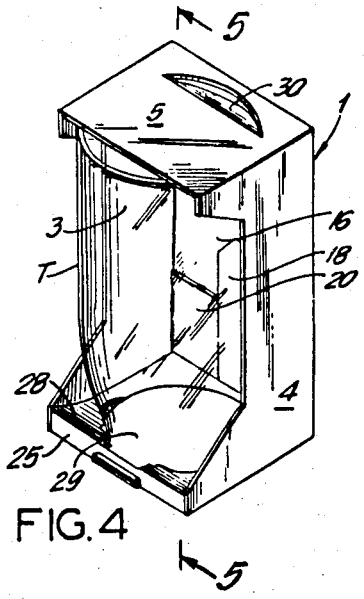
FIG. 4 is a perspective view showing the completed package with a tumber in place therein.
Figure 5:
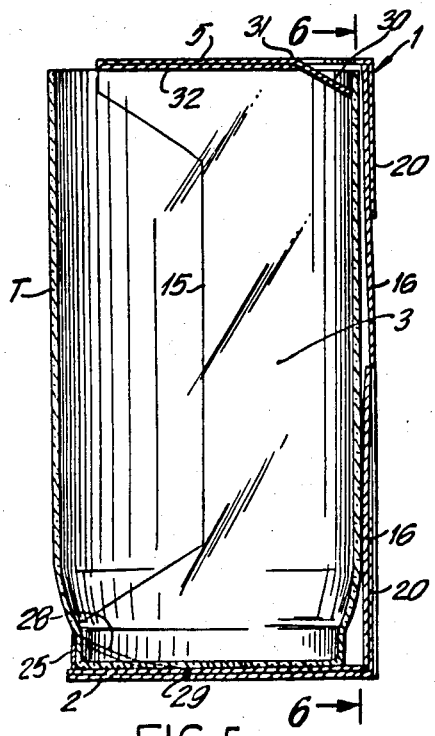
FIG. 5 is a sectional view taken along line 5—5 of FIG. 4.
Figure 6:
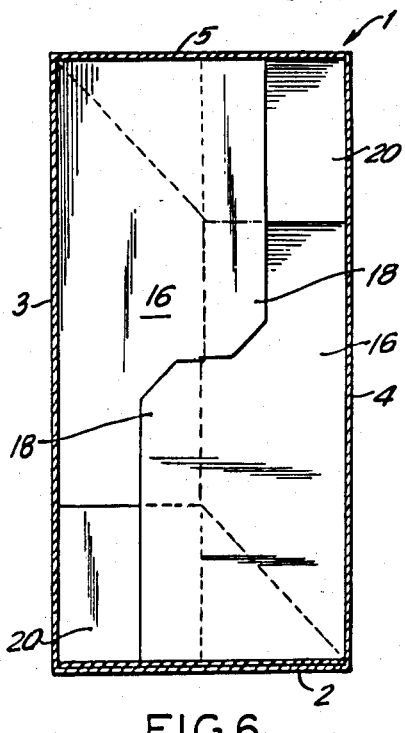
FIG. 6 is a sectional view taken along line 6—6 of FIG. 5.

To assemble the package as shown in FIGS. 2 and 3, the bottom, side and top wall panels 2, 3, 4 and 5, respectively, are folded along the fold lines 6, 7 and 8 and the glue flap 9 is adhered to the bottom wall panel 2. The rear wall panels 16 are folded so that they interlock with each other and with the rear flap panels 20 and are adhered thereto at the adhesive areas 19. The lower retaining wall panel 28 and the front step panel 25 are folded inwardly so that a step 25 is formed at the bottom and the tongue 29 is folded down to accommodate the bottom of a tumbler T. The upper pressure panel 32 is folded inwardly and the article retaining tongue 30 is folded down to hold a tumbler T in place as shown in FIGS. 4 and 5. This package may be used by itself or it may be combined with other similar packages, as will be more fully set forth hereinafter below.

Figure 7:
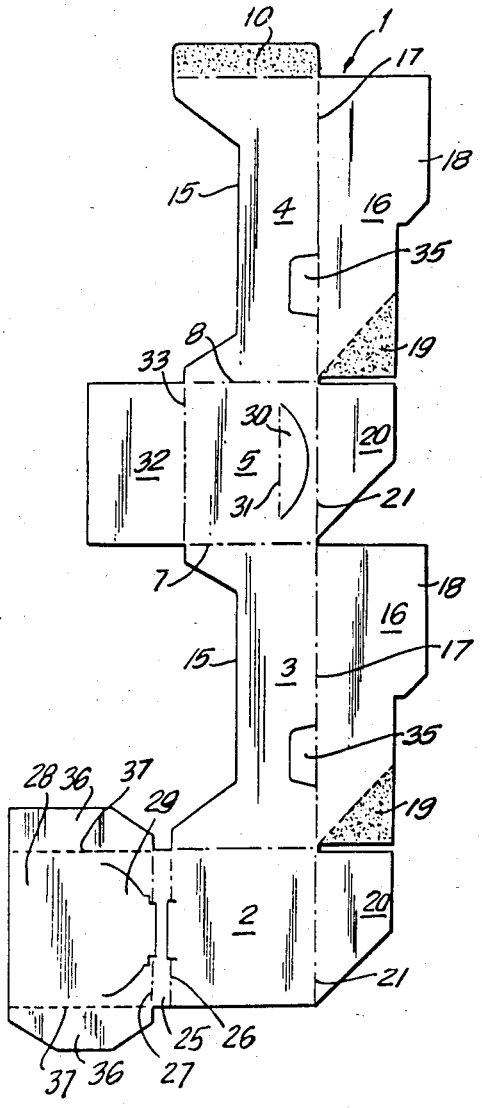
FIG. 7 is a plan view of a blank showing another embodiment of the present invention.
Figure 8:
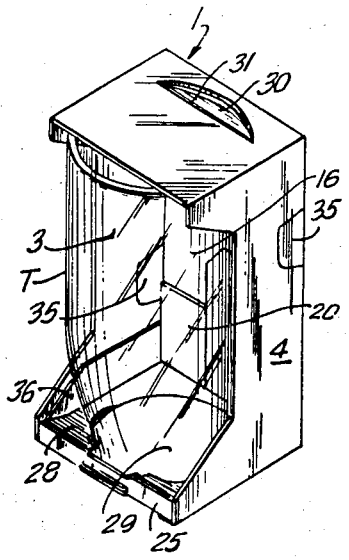
FIG. 8 is a perspective view of the finished package formed from the blank of FIG. 7.

FIGS. 7 and 8 show another embodiment of the package of the present invention which is substantially similar to the embodiment of FIGS. 1 to 6 and like parts have been given the same reference number. In this embodiment, each of the side walls 3 and 4 of package 1 is provided with a tongue 35 extending from the fold lines 17 to form slots. In addition, the lower retaining wall 28 has flap panels 36 extending therefrom and foldable relative thereto along fold lines 37.

Figure 9:
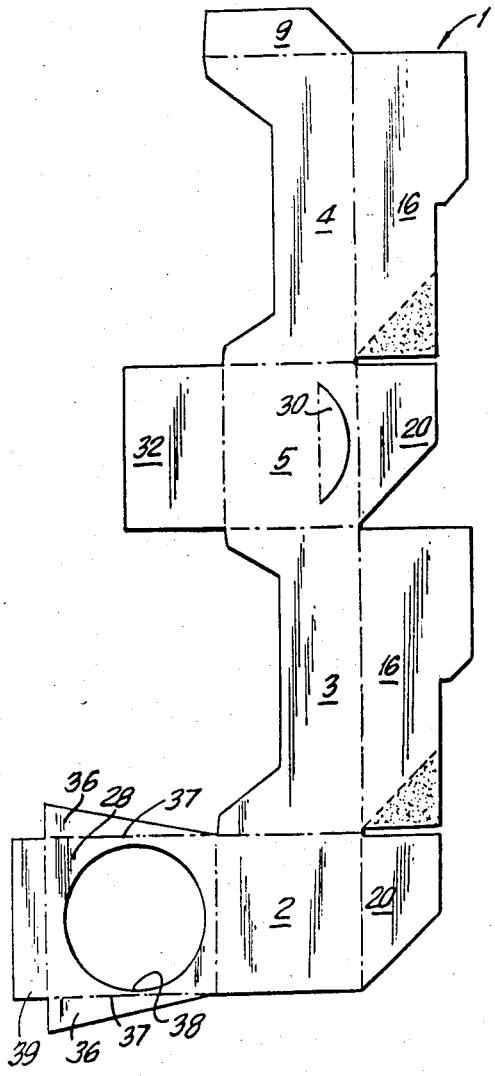
FIG. 9 is a plan view of a blank showing another embodiment of the present invention.
Figure 10:
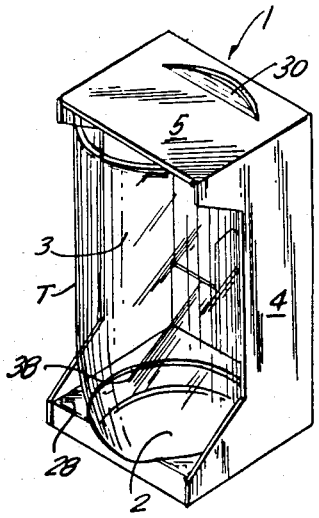
FIG. 10 is a perspective view of the finished package formed from the blank of FIG. 9.
Figure 11:
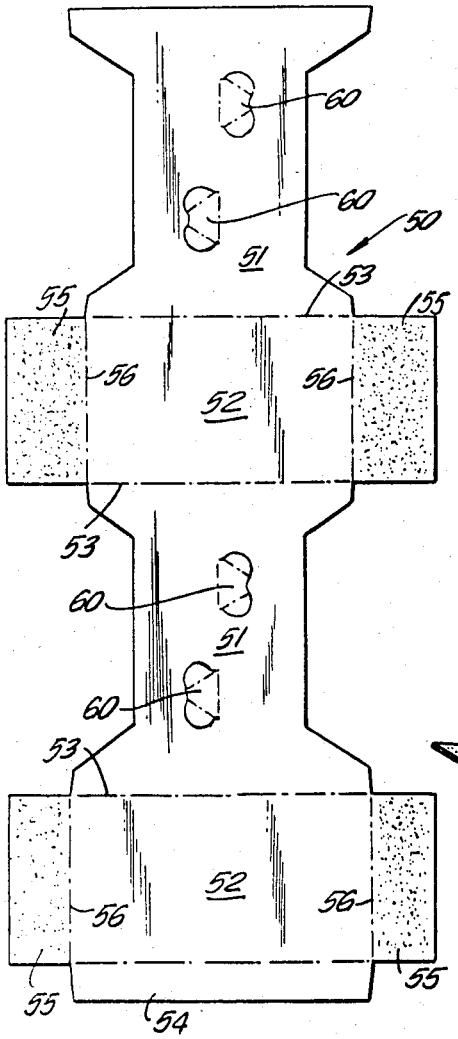
FIG. 11 is a plan view of a blank showing a sleeve for receiving two packages therein.

The embodiment shown in FIGS. 9 and 10 is generally similar to the embodiment shown in FIGS. 7 and 8. However, in this embodiment, the lower retaining wall 28 has an opening 38 therein to receive a tumbler T and a rear spacer panel 39 foldable relative thereto.

Figure 12:
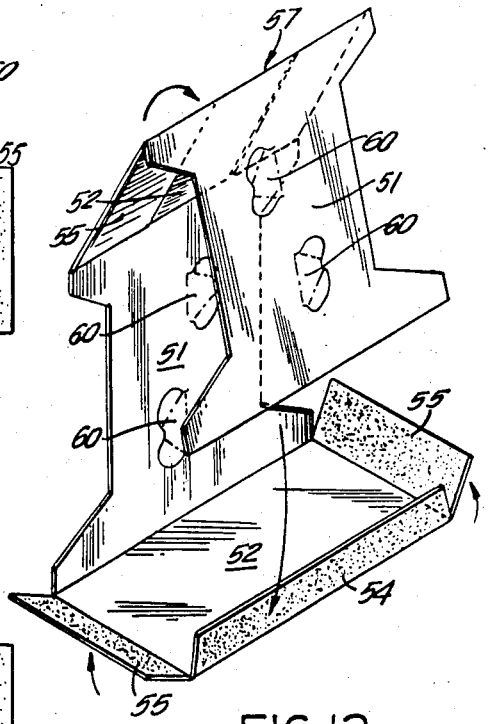
FIG. 12 is a perspective view showing the folding of the blank of FIG. 11 into a sleeve.
Figure 13:
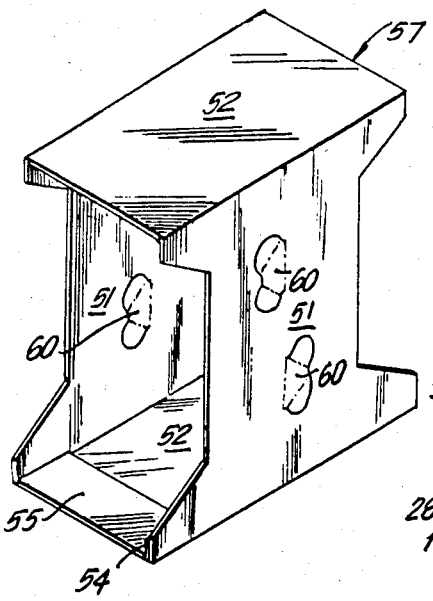
FIG. 13 is a perspective view showing the completed two package sleeve.
Figure 14:
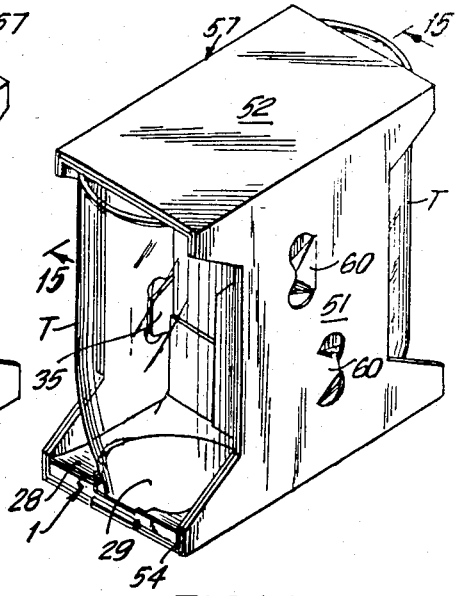
FIG. 14 is a perspective view showing the two package sleeve with packages therein.
Figure 15:
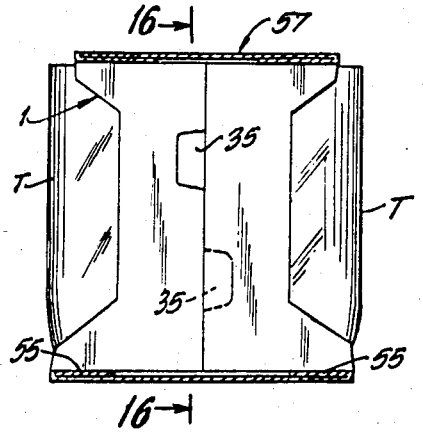
FIG. 15 is a sectional view taken along line 15—15 of FIG. 14.
Figure 16:
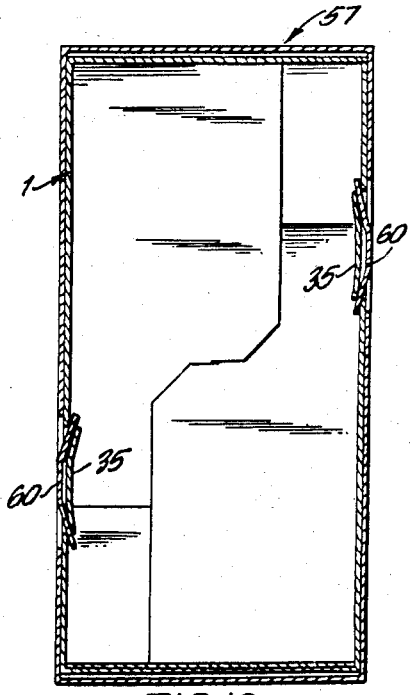
FIG. 16 is a sectional view taken along line 16—16 of FIG. 15.
Figure 17:
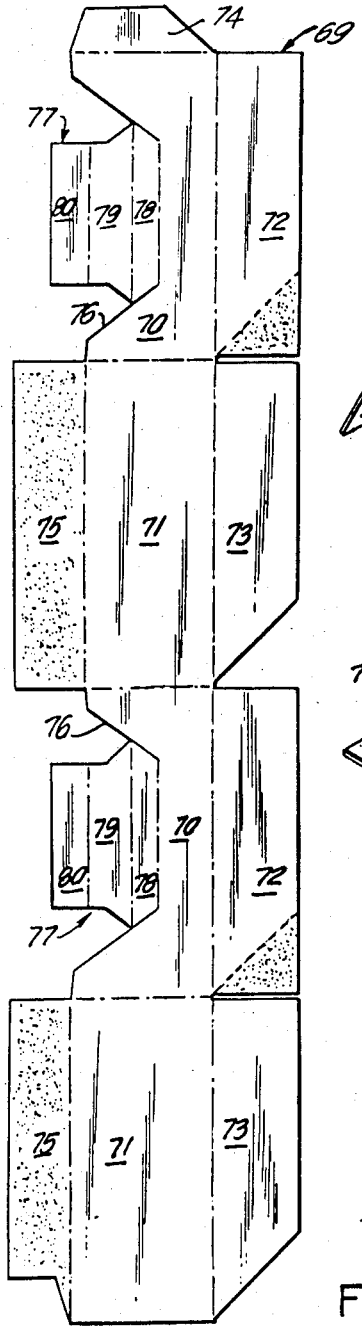
FIG. 17 is a plan view of a blank showing another embodiment of a two package sleeve.

FIGS. 11 to 16 show a two package sleeve formed from a blank 50 which has side wall panels 51 and top and bottom wall panels 52 along fold lines 53. The bottom wall panel has a glue flap 54 extending therefrom. The top and bottom wall panels 52 having reinforcing flaps 55 extending from their ends foldable along fold lines 56. Lock means 60 are provided in the side walls 51 in the form of foldable inwardly extending winged tabs. The blank 50 is folded as shown in FIG. 12 to form the two package sleeve 57 shown in FIG. 13. The reinforcing flaps 55 are folded back and adhered to the top and bottom walls 52. This two package sleeve is adapted to receive two packages 1, in back-to-back relationship as shown in FIG. 14. Preferably, the package 1 used is that shown in the embodiment of FIGS. 7–8 in which the lock tabs 60 of the sleeve are inserted into the slots 35 formed in the side walls 3 and 4 to hold the packages 1 in place.

Figure 18:
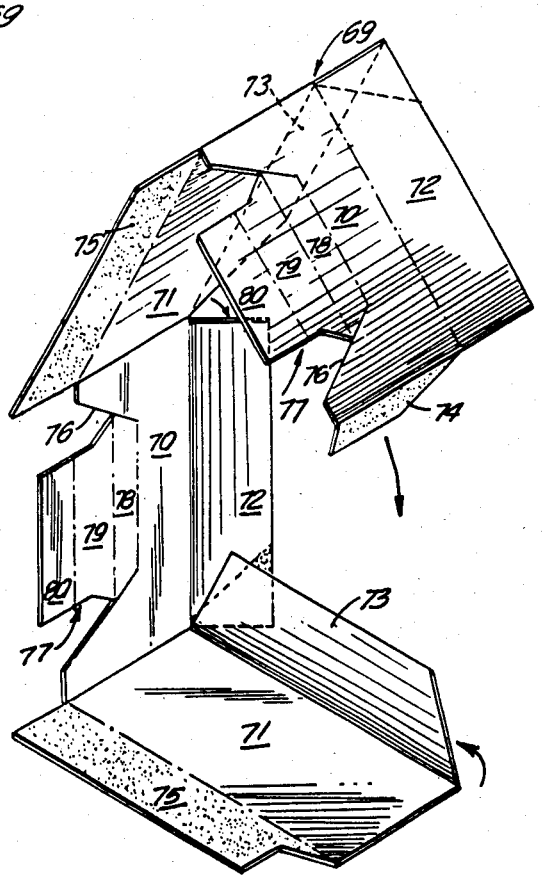
FIG. 18 is a perspective view showing the folding of the blank of FIG. 17 into a sleeve.
Figure 19:
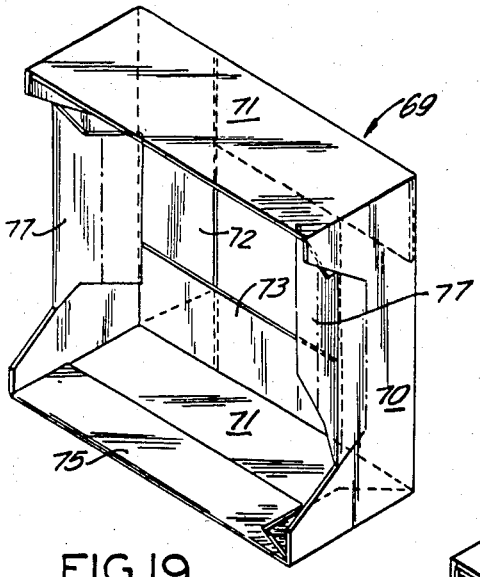
FIG. 19 is a perspective view of the completed two package sleeve.
Figure 20:
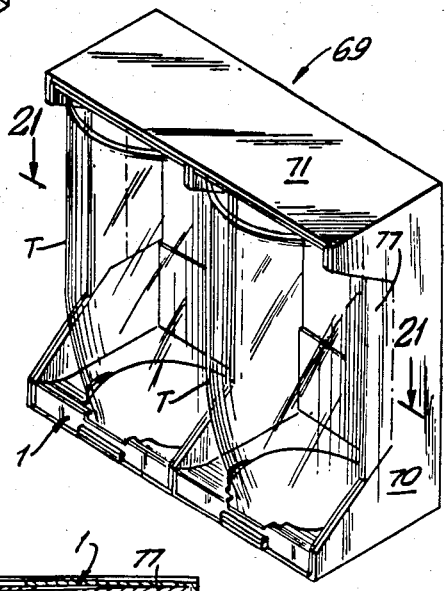
FIG. 20 is a perspective view of the two package sleeve with two display packages mounted therein.
Figure 21:
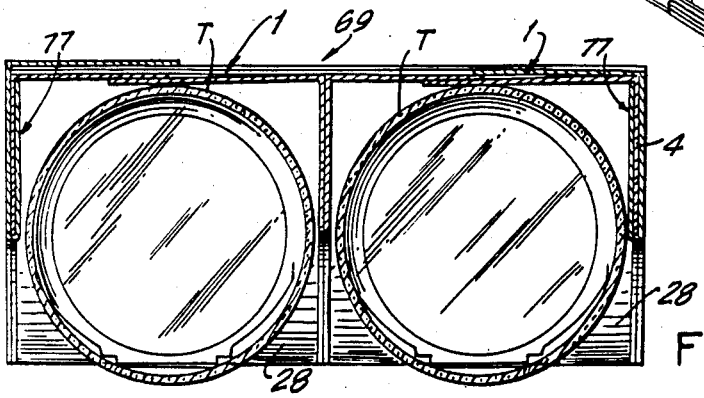
FIG. 21 is a sectional view taken along line 21—21 of FIG. 20.
Figure 22:
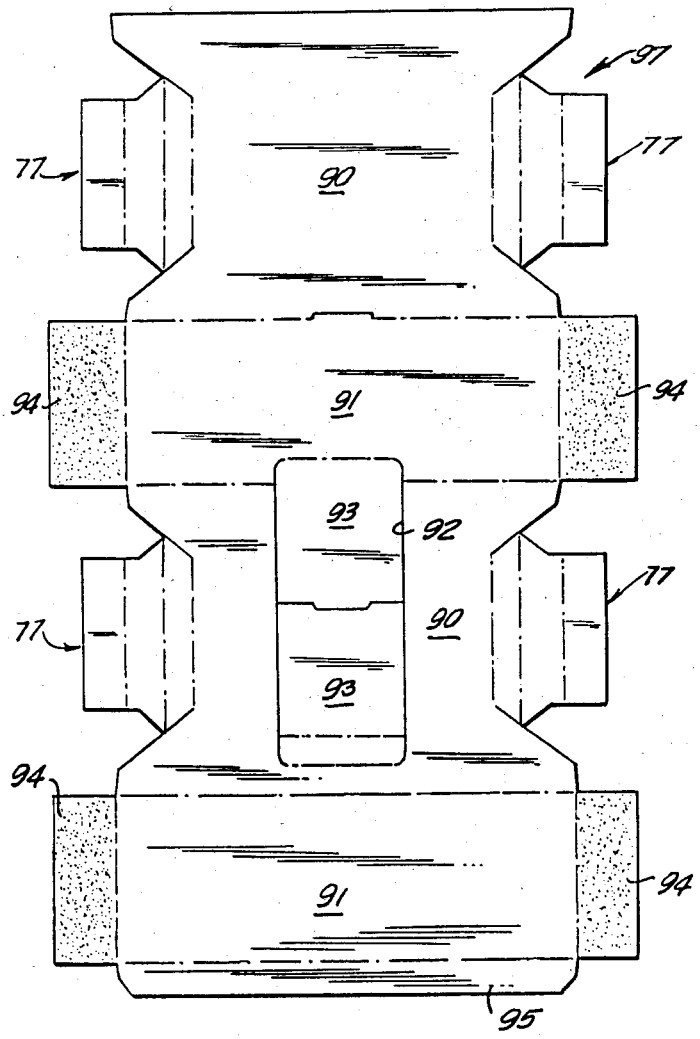
FIG. 22 is a plan view of a blank for a three package sleeve.

FIGS. 17 to 21 show a side-by-side two package sleeve 69 having side walls 70 foldable relative to top and bottom walls 71 along fold lines. The rear wall panels 72 and 73 are foldable relative thereto along fold lines and one of the side walls 70 has a glue flap 74. The top and bottom wall panels 71 are provided with reinforcing flaps 75 foldable inwardly and adhered thereto. The side wall panels 70 have cutouts 76 with retaining tabs 77 extending therefrom and foldable relative thereto. Each retaining tab 77 is formed of three sections 78, 79 and 80 foldable relative to each other along fold lines. When the blank for sleeve 69 is folded as shown in FIG. 18 to the position shown in FIG. 19, it will accommodate two packages 1 in side-to-side relationship as shown in FIG. 20. The retaining tabs 77 are adapted to wrap around the side walls 4 of each single package and hold them in place.

FIGS. 22 to 26 show a three package sleeve 97 which comprises side wall panels 90 and top and bottom wall panels 91 folded relative thereto along fold lines. One of the side wall panels 90 has an opening 92 formed by cut flap 93. Extending from the top and bottom panels are reinforcing flaps 94 adapted to be folded and adhered thereto. A glue flap 95 also extends from the bottom panel 91. Each of the side wall panels 90 have cutouts therein with retaining tabs 77 extending therefrom which are similar to the retaining tabs 77 of FIGS. 17 to 21.

Figure 23:
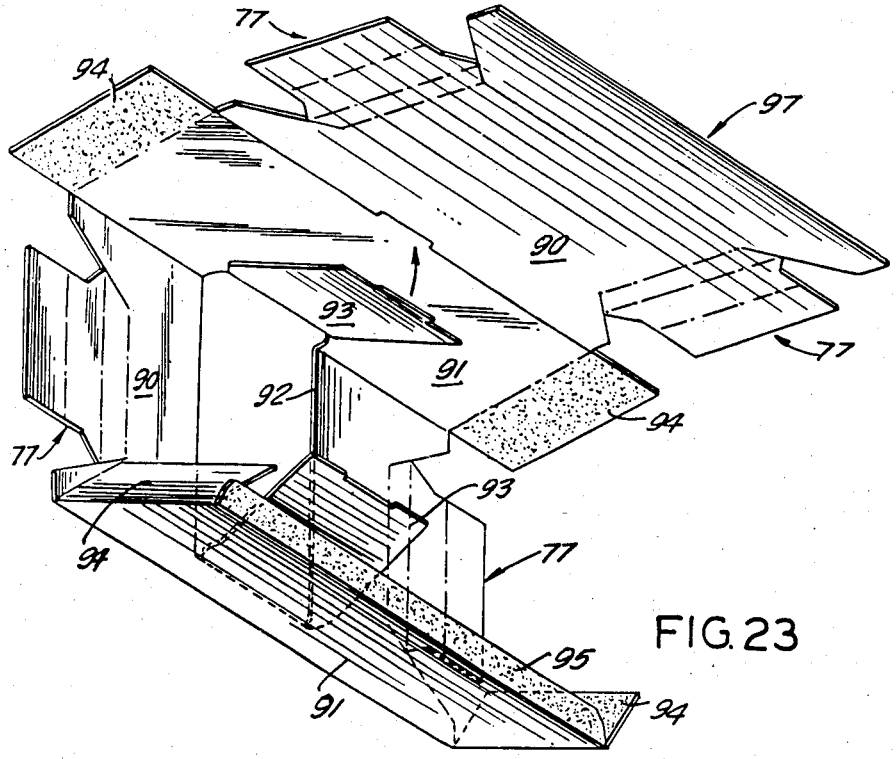
FIG. 23 is a perspective view showing an initial step in folding the blank into a three package sleeve.
Figure 24:
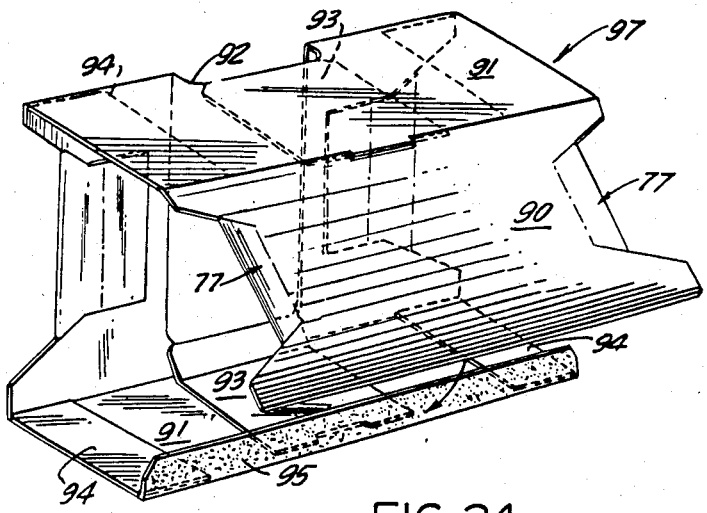
FIG. 24 is a perspective view showing the final folding operation of the three package sleeve.
Figure 25:
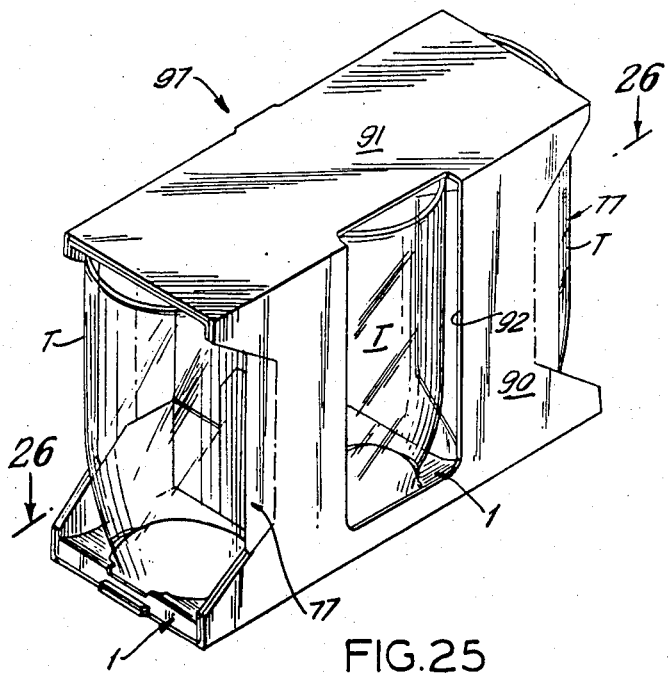
FIG. 25 is a perspective view showing the completed three package sleeve with three packages therein.
Figure 26:
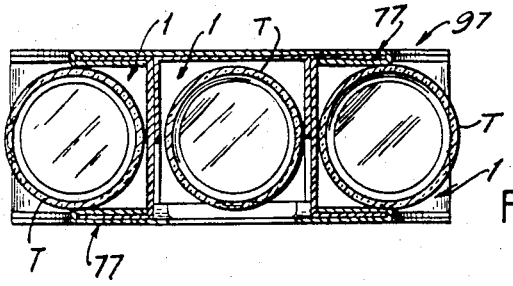
FIG. 26 is a sectional view taken along line 26—26 of FIG. 25.
Figure 27:
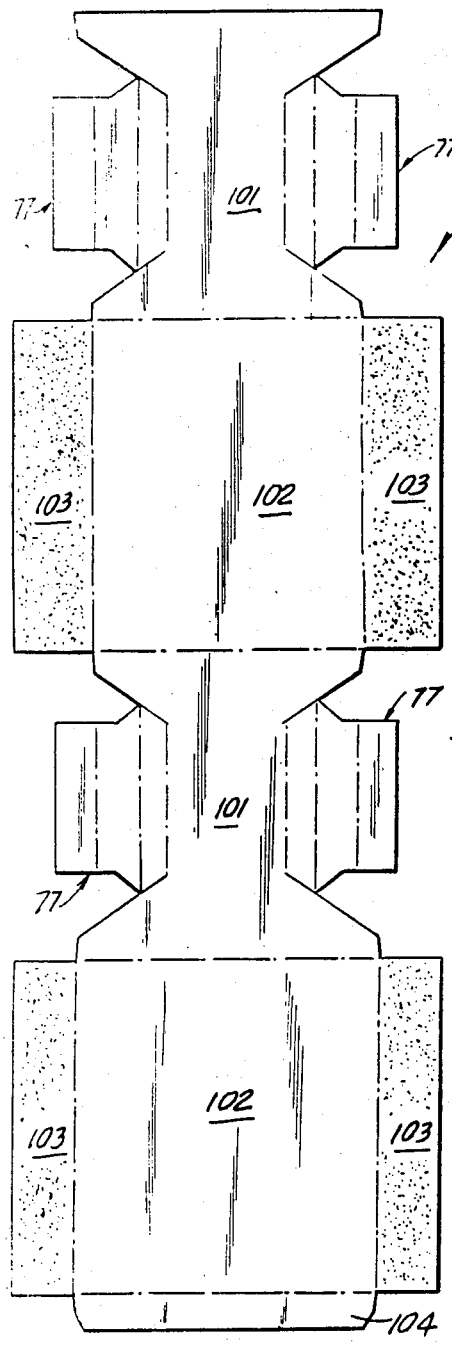
FIG. 27 is a plan view of a blank for a four package sleeve.
Figure 28:
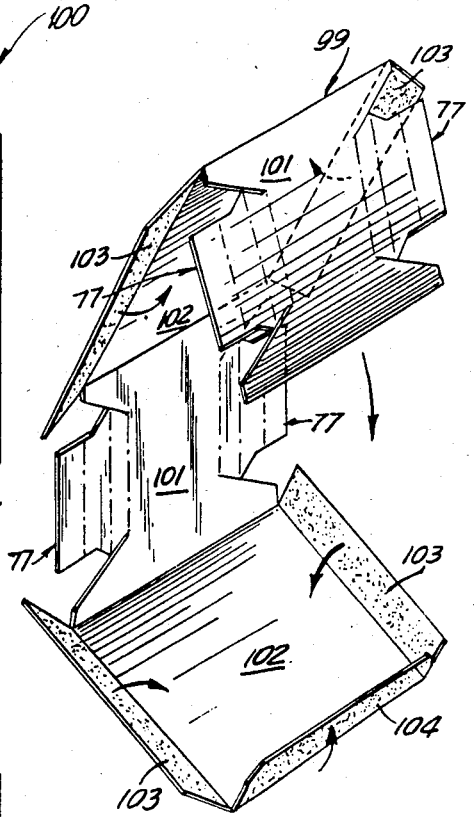
FIG. 28 is a perspective view showing the folding of the blank into a four package sleeve.

The blank 97 is folded in the manner shown in FIGS. 23 and 24 to form the finished three package sleeve 97 as shown in FIG. 25. The three package sleeve 97 is adapted to receive a single package in its center facing the opening 92 with a pair of additional packages inserted at its end which face outwardly and are retained therein by the retaining tabs 77.

FIGS. 27 to 30 show a four package sleeve 99 formed from a blank 100 which comprises side wall panels 101 and top and bottom wall panels 102 folded relative thereto along fold lines. Extending from the top and bottom wall panels 102 are retaining flaps 103 adapted to be folded and adhered thereto. A glue flap 104 also extends from the bottom panel 102. Each of the side walls 101 has a pair of opposed cutouts and retaining tabs 77 extending similarly to the retaining tabs 77 of the embodiment of FIGS. 17 to 21.

Figure 29:
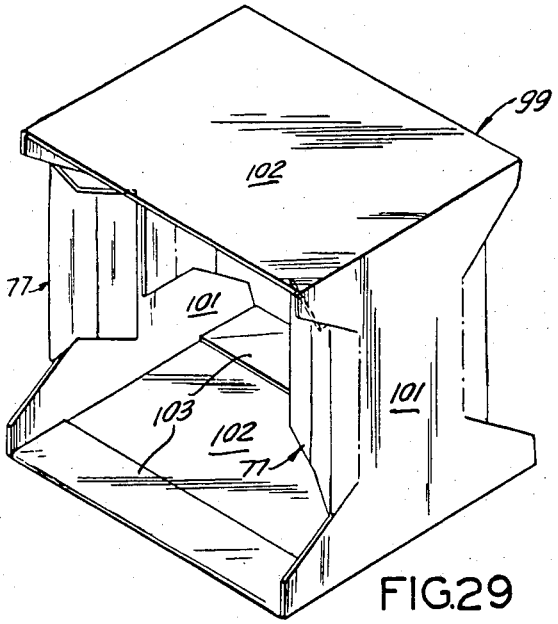
FIG. 29 is a perspective view of the completed four package sleeve.
Figure 31:
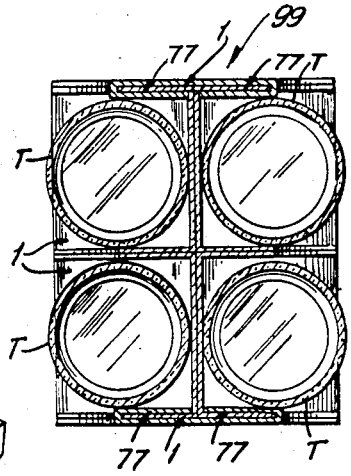
FIG. 31 is a sectional view taken along line 31—31 of FIG. 30.
Figure 30:
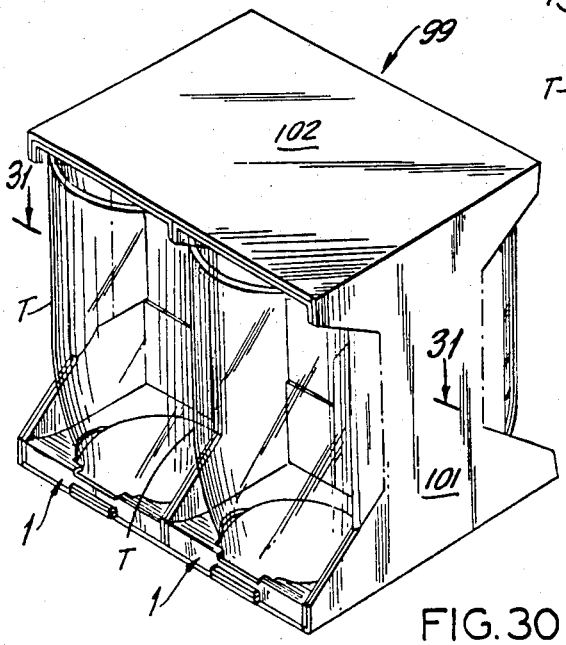
FIG. 30 is a perspective view of the four package sleeve with four packages therein.

The blank 100 is folded in the manner shown in FIGS. 29 and 30. The sleeve is adapted to accommodate four packages which face outwardly and which are retained therein by the tabs 77.

Figure 32:
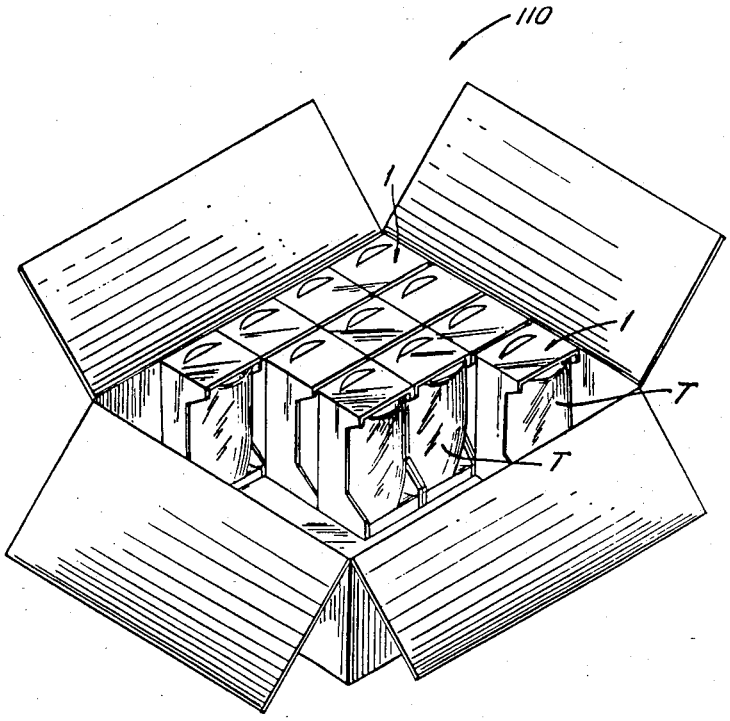
FIG. 32 is a perspective view showing one manner of packing the packages in a shipping carton.

FIG. 32 shows the manner of packing packages 1 in a shipping container 110. The individual packages 1 may be packed, however, it is also possible to package the two, three or four package sleeves 57, 69, 97, or 99 in any combination desired for obtaining the most efficient package.

It will thus be seen that the present invention provides an improved display package which can be easily erected and packed in shipping cartons by automatic machinery, which has maximum visibility, insures protection from damage and permits inspection by the consumer without destroying the display package. The package also is able to accommodate stemware as well as tumblers and is capable of accommodating a multiplicity of sizes. It is also amenable to palletization and permits opening of the outer cartons for pricing and label application and it eliminates the use of partitions for separating the articles, increases the protection of the glassware packaged therein, and requires less shelf space. It also permits diverse utilization for differing displays and marketing requirements.

As many and varied modifications of the subject matter of this invention will become apparent to those skilled in the art from the detailed description given hereinabove, it will be understood that the present invention is limited only as provided in the claims appended hereto.

What is claimed is:

1. The combination of a modular display package for individual articles having rear, top, bottom and side wall assemblies and an article within the confines of said rear top, bottom and side wall assemblies with said side wall assemblies having cutouts extending inwardly toward said rear wall assembly, and a package sleeve for packaging a plurality of said modular display packages with portions of the individual articles exposed for inspection comprising a package blank having a top panel, a bottom panel, and a pair of side panels, package engaging lock means on said side panels, and one free edge of one side panel being fastened to a free edge of said top or bottom panel to form said package sleeve, said package engaging lock means comprising a plurality of foldable retaining lock tabs on said side walls, said side walls having cutouts and said foldable retaining lock tabs being hingedly attached to and extending from said side walls at the cutouts, said retaining lock tabs cooperating with and foldable around the cutouts in the side wall panels of the modular display packages to hold the modular display packages securely in place within said sleeve.

2. The sleeve as claimed in claim 1 in combination with a plurality of display packages within said sleeve with portions of the packaged articles being exposed through the sleeve side walls.

3. The sleeve as claimed in claim 2 in which said plurality comprises three display packages.

4. The sleeve as claimed in claim 3 in combination with three display packages within said sleeve, with the central package of the three being positioned at said viewing opening.

* * * * *